US008539864B1

(12) United States Patent
Kennedy

(10) Patent No.: US 8,539,864 B1
(45) Date of Patent: Sep. 24, 2013

(54) DUAL-HANDLED DRIVE WRENCH

(76) Inventor: Justin A. Kennedy, Dillsboro, IN (US)

( * ) Notice: Subject to any disclaimer, the term of this patent is extended or adjusted under 35 U.S.C. 154(b) by 183 days.

(21) Appl. No.: 13/206,625

(22) Filed: Aug. 10, 2011

Related U.S. Application Data

(63) Continuation of application No. 13/156,853, filed on Jun. 9, 2011, now abandoned.

(60) Provisional application No. 61/376,854, filed on Aug. 25, 2010.

(51) Int. Cl.
*B25B 23/00* (2006.01)
*B25B 13/46* (2006.01)

(52) U.S. Cl.
USPC ..... 81/177.8; 81/60

(58) Field of Classification Search
USPC ..... 81/177.6, 177.7, 177.8, 60–63, 63.1, 81/63.2
See application file for complete search history.

(56) References Cited

U.S. PATENT DOCUMENTS

| | | | | |
|---|---|---|---|---|
| 2,465,152 | A * | 3/1949 | Ellison | 81/121.1 |
| 4,095,494 | A | 6/1978 | Castoe | |
| 4,184,783 | A * | 1/1980 | Hall | 403/157 |
| 4,790,219 | A * | 12/1988 | Will | 81/63 |
| 4,799,832 | A | 1/1989 | Abbott | |
| 4,934,220 | A | 6/1990 | Slusar et al. | |
| 4,984,942 | A | 1/1991 | Holtz | |
| 5,280,740 | A | 1/1994 | Ernst | |
| 5,461,950 | A | 10/1995 | Iwinski | |
| 5,481,947 | A * | 1/1996 | Banns | 81/177.2 |
| 5,495,783 | A | 3/1996 | Slusar et al. | |
| 5,875,693 | A | 3/1999 | Zurbuchen et al. | |
| D409,060 | S * | 5/1999 | Lucy | D8/24 |
| 5,921,158 | A | 7/1999 | Slusar et al. | |
| 6,112,625 | A | 9/2000 | Turtle | |
| 6,240,809 | B1 * | 6/2001 | Sasarak | 81/60 |
| 6,286,396 | B1 | 9/2001 | Johnson | |
| 6,343,532 | B1 * | 2/2002 | Lucy | 81/177.6 |
| 6,349,620 | B1 | 2/2002 | Anderson | |
| 6,405,621 | B1 | 6/2002 | Krivec et al. | |
| 6,792,830 | B2 | 9/2004 | DeKeuster et al. | |
| 6,898,998 | B2 | 5/2005 | Shyu | |
| 6,938,521 | B1 * | 9/2005 | Skeens | 81/60 |
| 6,945,145 | B1 | 9/2005 | Kesinger | |
| 7,093,519 | B1 | 8/2006 | Huang | |
| 7,197,965 | B1 | 4/2007 | Anderson | |
| 7,389,700 | B2 | 6/2008 | Gao | |
| 2011/0079115 | A1 * | 4/2011 | Johnson et al. | 81/63.1 |

OTHER PUBLICATIONS

"Snap-On Quick Release Head Ratchet" http://buy1.snapon.com/catalog/item.asp?P65=&tool=&item_ID=67488&group_ID=24803&store=snapon-store&dir=catalog, undated (1 page).

(Continued)

*Primary Examiner* — David B Thomas
(74) *Attorney, Agent, or Firm* — Hasse & Nesbitt LLC; Daniel F. Nesbitt

(57) ABSTRACT

A dual-handled ratcheting socket wrench having a drive head and a pair of handles pivotably attached at opposite ends of the drive head, and a manually-withdrawable, quick-release pin extending through each handle and the drive head to form a hinge. The quick-release pin can be withdrawn manually from the aligned holes without the use of a hand tool. The dual-handled ratcheting socket wrench can have a locking mechanism for independently securing the handles at a variable pivot position relative to the drive head. The dual-handled socket wrench allows a mechanic to apply substantially equal, co-rotational force to each handle.

9 Claims, 11 Drawing Sheets

(56) References Cited

OTHER PUBLICATIONS

"Snap-On Flex Handle Ratchet" http://buy1.snapon.com/catalog/item.asp?P65=&tool=&item_ID=83985&group_ID=21944&store=snapon-store&dir=catalog, undated (1 page).

"Snap-On Locking Flex Handle Ratchet" http://buy1.snapon.com/catalog/item.asp?P65=&tool=&item_ID=83987&group_ID=21944&store=snapon-store&dir=catalog, undated (1 page).

* cited by examiner

DUAL-HANDLED DRIVE WRENCH

CROSS REFERENCE TO RELATED APPLICATIONS

This application claims the benefit of U.S. Provisional Application No. 61/376,854, filed on Aug. 25, 2010, and is a continuation of U.S. application Ser. No. 13/156,853, filed on Jun. 9, 2011 (abandoned) the disclosures of which are incorporated herein by reference in their entirety.

BACKGROUND OF THE INVENTION

1. Field of the Invention

This invention relates to a ratchet wrench, and more particularly, to a ratcheting socket wrench with dual, multi-position handles.

2. Background

Single-handled, reversible ratcheting socket wrenches are used by mechanics worldwide for loosening or tightening bolts using short, repeated ratcheting movements of the handle, to alternately drive by rotation a socket drive in a first direction, followed by return ratcheting the handle to the original position without reverse rotating of the socket drive. The drive direction to either tighten or loosen a bolt or nut is selected using a reversing switch or other well-known mechanism. Example(s) of single-handled reversible ratcheting socket wrenches that ratchet the handle in an arc around the rotating axis of the socket drive are shown in U.S. Pat. Nos. 6,286,396, 5,280,740, 6,405,621, and 6,112,625, the disclosures of which are incorporated by reference in their entirety. FIG. 1 illustrates such a conventional embodiment, where the force (Fh) applied to the handle of the wrench applies torque to the bolt. As shown, the applied force (Fh) to the handle is applied around the drive axis in the plane Ph of the drive handle, but axially offset from the plane Pb through head of the bolt, or from the nut, upon which the socket works. The application of the torsional force Fh to the end of the handle that is offset axially from the bolt head, results in both a rotational torque, Th, in the horizontal plane, Ph, of the handle, around the axis of the bolt to loosen or tighten the bolt, as well as a revolving torque, Tr, in a vertical plane, Pr, that acts upon the socket to roll or twist up the socket off of the bolt head when substantial force is applied; for example when attempting to loosen a stubborn bolt. To prevent the socket from rolling off the bolt head, the mechanic often places his free hand onto the top of the drive head and applies a counter-revolving torque, Tm, to the socket. This, however, can be a significant problem with larger sockets wrenches and drives that can require a mechanic to use both hands to manage and drive the wrench handle, or where space for positioning the hand on the drive head is minimal. Also known are single-handled reversible ratchet socket wrenches with a hinge attachment of the handle to the ratchet head so that wrench handle can be pivoted to an angle relative to the torque plane. Such hinges can be configured to pivot freely, or to be securable in multiple positions using a pivot locking means. Example(s) of such ratcheting socket wrenches having pivotable handles are shown in U.S. Pat. Nos. 6,286,396, 5,280,740, 6,405,621, and 6,112,625, the disclosures of which are incorporated by reference in their entirety. FIG. 2 illustrates such a conventional embodiment of a hinged-handled socket wrench, which allows the user to pivot the handle to avoid an obstruction in the drive plane (Psh). However, a significant disadvantage of such is that the application of ratcheting force in a plane through the end of the handle, Ph, is even further offset axially from the plane, Pb, through the bolt head, which increases the revolving torque, Tr, acting upon the socket, to roll the socket off of the bolt head. The mechanic even moreso needs to apply counter-revolving torque, Tm, to the socket to prevent the socket from slipping off the bolt head.

Therefore, there remains a need to provide for ratcheting socket wrenches that enable the user to apply significant torsional force to a bolt, nut or other figures requiring torsional force, which overcomes the problems addressed above.

SUMMARY OF THE INVENTION

An aspect of the invention is a dual-handled drive wrench, including two opposed handles. The dual-handled drive wrench can include a socket wrench, a ratchet wrench, a tap wrench, or similar drive tool.

A further aspect of the invention is a dual-handled socket wrench having opposed pivot-positionable handles that allows a mechanic using the wrench to apply substantially equal, co-rotational force to each handle, which applies co-directional torque to the drive socket around the axis of the bolt.

Another aspect of the invention is the dual-handled drive wrench having two handles hingedly attached at opposed sides of the drive head of the drive wrench, to allow the handles to pivot independently. A further aspect of the invention is the hinged, dual-handled drive wrench including a means for locking or securing selectively the pivoting handle in a pivoted position.

Another aspect of the present invention a dual-handled ratchet wrench with two multi-positionable hinged handles at opposed sides of the drive head of the ratchet wrench, that can be selectively positioned and secured for putting opposed, co-directional torque upon the drive socket or other driven tool driven by the ratchet wrench.

Another aspect of the invention is the dual-handled drive wrench is a means for quickly and easily removing either or both handles manually, without the use of a hand tool, including a quick release pin. A further aspect of the invention is the quick-release pin for hinging the handles to the drive head.

Another aspect of the invention is the dual-handled drive wrench that allows the mechanic to pivot independently the opposed handles to allow the ratchet head to be reached down in tight spaces to tighten or loosen bolt heads or nuts. A further aspect allows the mechanic to pivot independently and to secure in pivoted position the opposed handles to allow the ratchet head to be reached down in tight spaces to tighten or loosen bolt heads or nuts.

The present invention provides a dual-handled drive wrench, and in particular a ratcheting socket wrench, that includes a drive head and a pair of handles pivotably attached at opposite ends of the drive head, and a manually-withdrawable, quick-release pin extending through each handle and the drive head to form a hinge. The quick-release pin can be withdrawn manually from the aligned holes without the use of a hand tool. The dual-handled ratcheting socket wrench can have a locking mechanism for independently securing the handles at a variable pivot position relative to the drive head.

The present invention provides a dual-handled drive wrench, comprising: a) a drive head including a drive post extending along a drive axis, and opposed first and second shanks extending radially from the drive axis, the first and second shanks each having a hole through the shank along a handle pivot axis; b) a first handle and a second handle, each including a clevis at a proximal end having aligned holes through the legs of the clevis, the holes of the legs of the clevis aligned with the hole of the shank to provide a hinge that pivots around the handle pivot axis; and c) a manually-withdrawable, quick-release pin extending through the aligned holes of the clevis legs and shank, which can be withdrawn manually from the aligned holes without the use of a hand tool.

The present invention further provides that the drive head includes a ratcheting mechanism for the drive post, and a drive-direction selection switch.

The present invention further provides that the quick-release pin includes a spring-loaded ball detent mechanism at a distal end, and a grasping means at the proximal end for withdrawing the quick-release pin from the aligned holes of the clevis legs and shank by an axially applied pulling force. The present invention further provides that the grasping means is a ring through the proximal end, which has an opening through which a finger can be inserted.

The present invention further provides a locking mechanism for independently securing at least one of the first handle and the second handle at a variable pivot position relative to the respective shank of the drive head. The shank further includes a part-cylindrical surface with head teeth thereon, and a rod having rod teeth and disposed within and moveable axially within a bore of the handle between an engaged position wherein the rod teeth engage the head teeth for locking the handle in a selected pivot position relative to the drive head, and a non-engaged position wherein the rod teeth are disengaged from the head teeth to allow relative pivoting movement of the handle around the handle pivot axis.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings one or more non-limiting embodiments thereof, from which, when considered in connection with the following description, the invention, its construction and operation, and many of its advantages should be readily understood and appreciated.

DETAILED DESCRIPTION OF THE INVENTION

Figures 1, 2:
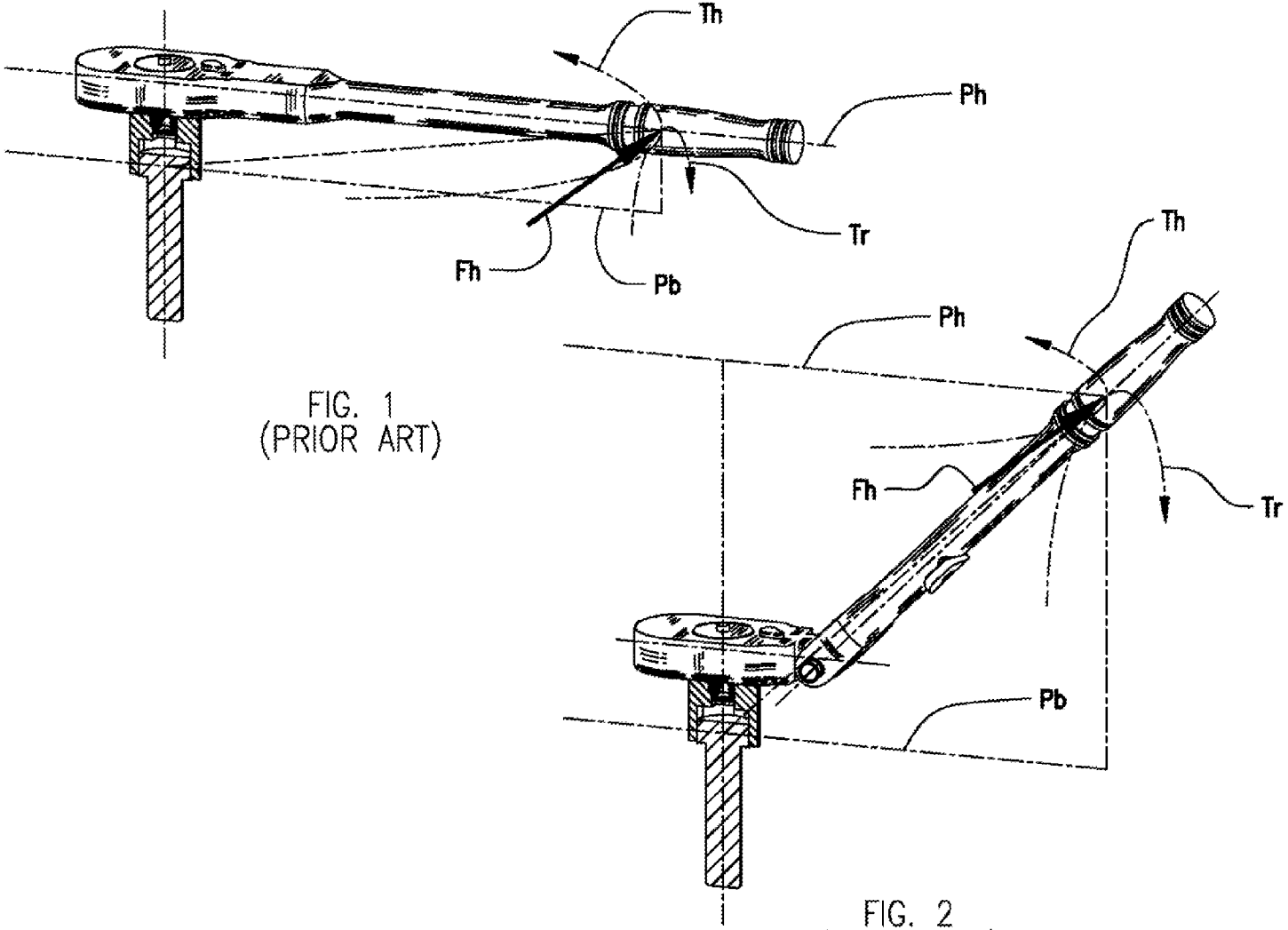
FIG. 1 (PRIOR ART)
FIG. 2 (PRIOR ART)
FIG. 1 illustrates a single-handled socket wrench of the prior art, showing the application of force and torque in the plane of the drive head different from the plane of the socket.
FIG. 2 illustrates a single-handled socket wrench of the prior art having a pivot-positionable handle, showing the application of force and torque in a plane different from the plane of the drive head and from the plane of the socket.
Figure 3:
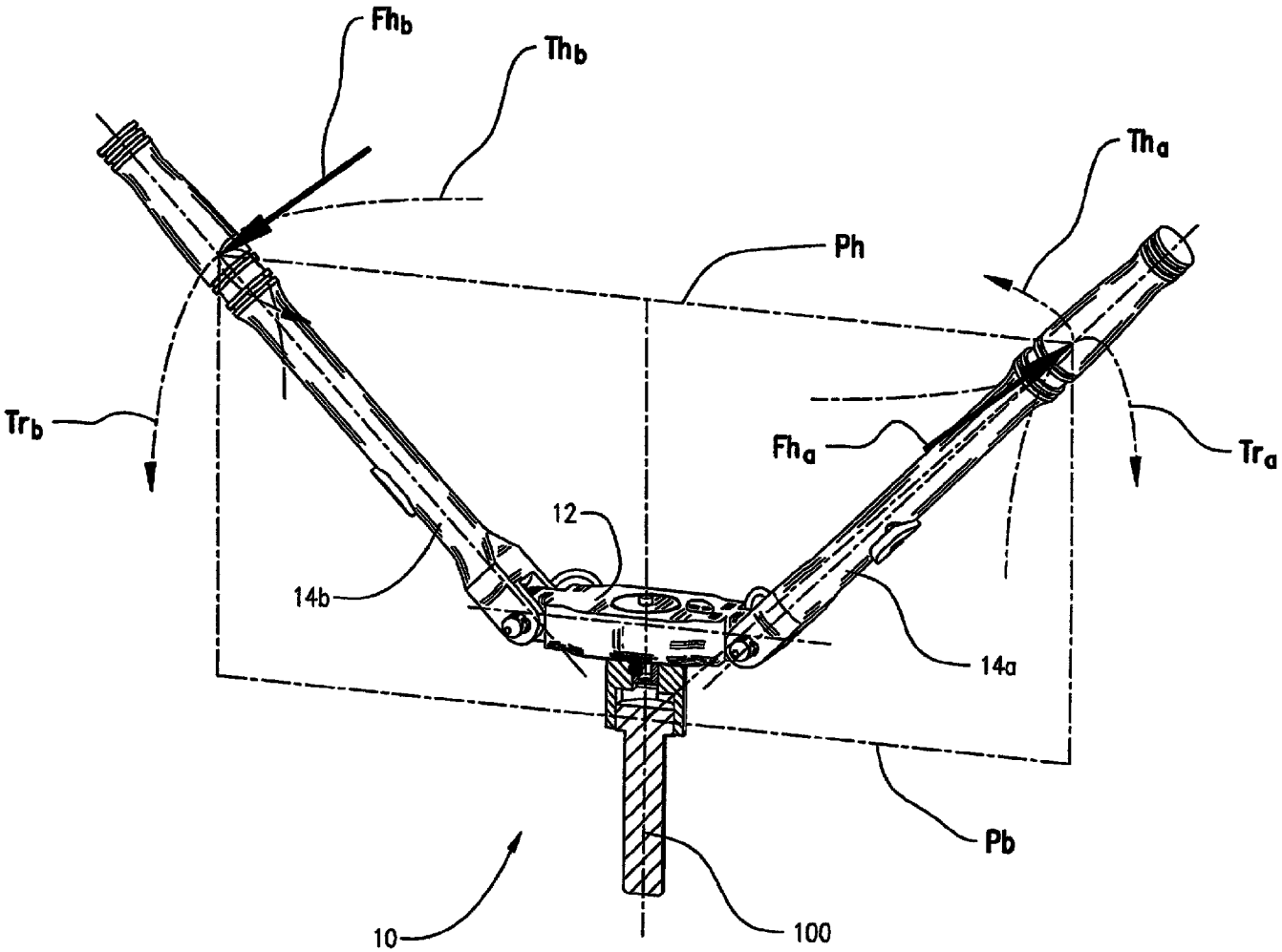
FIG. 3 illustrates a dual-handled socket wrench of the present invention having opposed pivot-positionable handles, showing the application of co-rotational torque in the horizontal plane around the drive axis, and stabilizing, counter-directional torque in the vertical plane.
Figure 4:
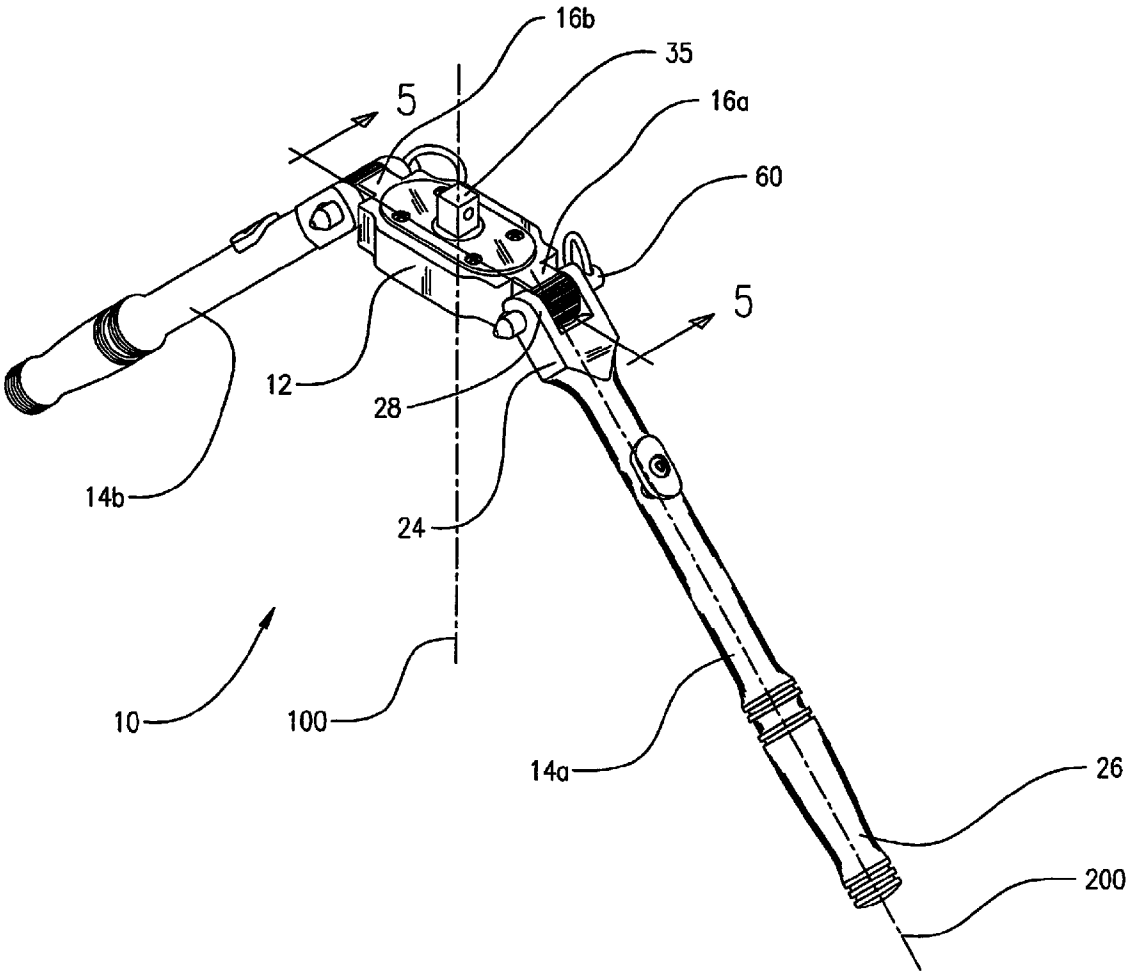
FIG. 4 shows a perspective view of a dual handled ratchet wrench of an embodiment of the present invention.

FIGS. 3-10 show an embodiment of a dual-handled ratchet wrench 10 of the present invention. The dual-handled ratchet wrench 10 includes a multi-position ratchet head 12 hingedly coupled to two opposed elongated handles 14*a* and 14*b*. As illustrated in FIG. 3, when co-rotational torsional forces $Fh_a$ and $Fh_b$ are applied to the opposed handles 14*a* and 14*b* in the same plane Ph, the opposed counter-directional torque $Tr_a$ and $Tr_b$ in the vertical planes cancel one another to stabilize the wrench on the bolt, while co-rotational torque $Th_a$ and $Th_b$ cooperate to rotate the bolt around drive axis 100. This allows the mechanic to apply substantially equal force on each handle to tighten or loosen bolts and nuts.

The ratchet head 12 includes a conventional ratchet system 13 for selectively and alternately driving and ratcheting a drive post 35 in either rotational direction around a drive axis 100, and two opposed engaging shanks 16*a* and 16*b*. Each engaging shank 16, such as shank 16*a*, includes a part-cylindrical surface 18 having a plurality of head teeth 20 thereon. The engaging shank 16 also includes a smooth cylindrical bore 22 disposed therethrough and having a bore axis 21. Each of the head teeth 20 has a centerline 23 radiating from the bore axis 21. The centerlines 23 between adjacent teeth are spaced to allow the handle 14 to be put into one of multiple selected angular positions relative to a plane 100 passing through the body of the drive head 12. The amount of angular spacing between teeth 20 determines the number of selected positions. An angular spacing ($\alpha$) of fifteen degrees between adjacent centerlines 23 can be used, but other angular spacings are possible and usable.

Examples of ratcheting systems include those described in U.S. Pat. Nos. 6,792,830, 5,921,158, 5,875.693, 5,495,783, and 4,934,220, the disclosures of which are incorporated by reference in their entirety. A selecting switch 37, shown in FIG. 7, on the opposite side of the drive head 12, allows the user to selectively configure the ratcheting system to drive and ratchet alternatively the drive post 35 in opposed right-handed and left-handed rotating directions around drive axis 100. The drive post 35 is typically square in planar cross section in standard sizes ranging from ¼ inch to 1 inch, including ⅜ inch, ½ inch and ¾ inch, and larger.

Each handle 14 includes a clevis 24 at a proximal end closest to the drive head 12, and a second distal or handling end 26. A longitudinal axis 200 extends between the clevis 24 ends and the handling end 26. The clevis 24 includes two legs 28 connected by a wall 31, and disposed on opposite sides of the shank 16. Each clevis leg 28 has a bore 30 therethrough coaxially aligned with the bore 22 of the shank 16.

A pin 60, described hereinafter, provides a means for pivoting the handle 14 relative to the drive head 12 to form a hinge.

Figure 5:
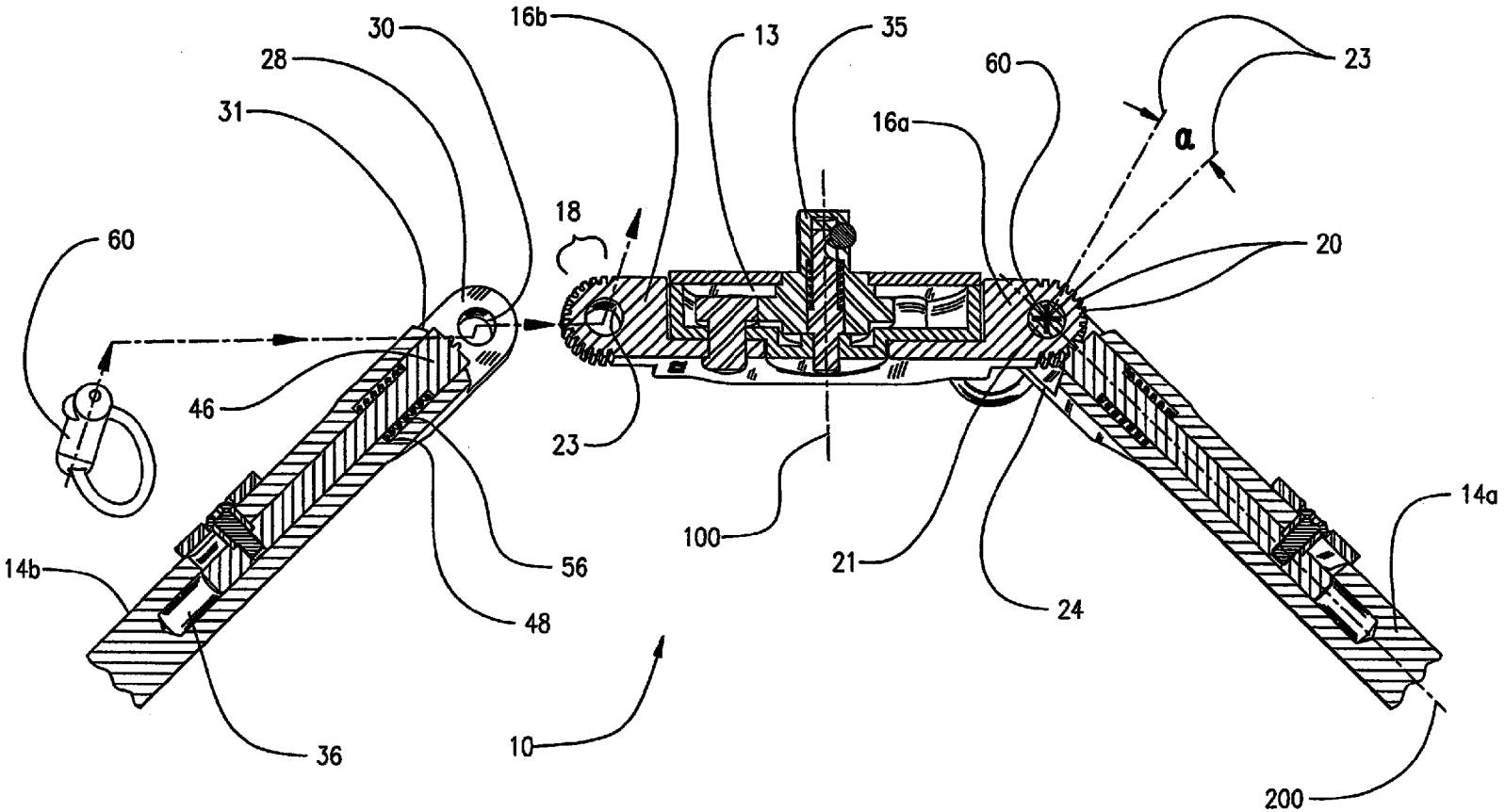
FIG. 5 shows a sectional view of the ratchet wrench through line 5-5 of FIG. 4, with one handle disassembled from the drive head.
Figure 6:
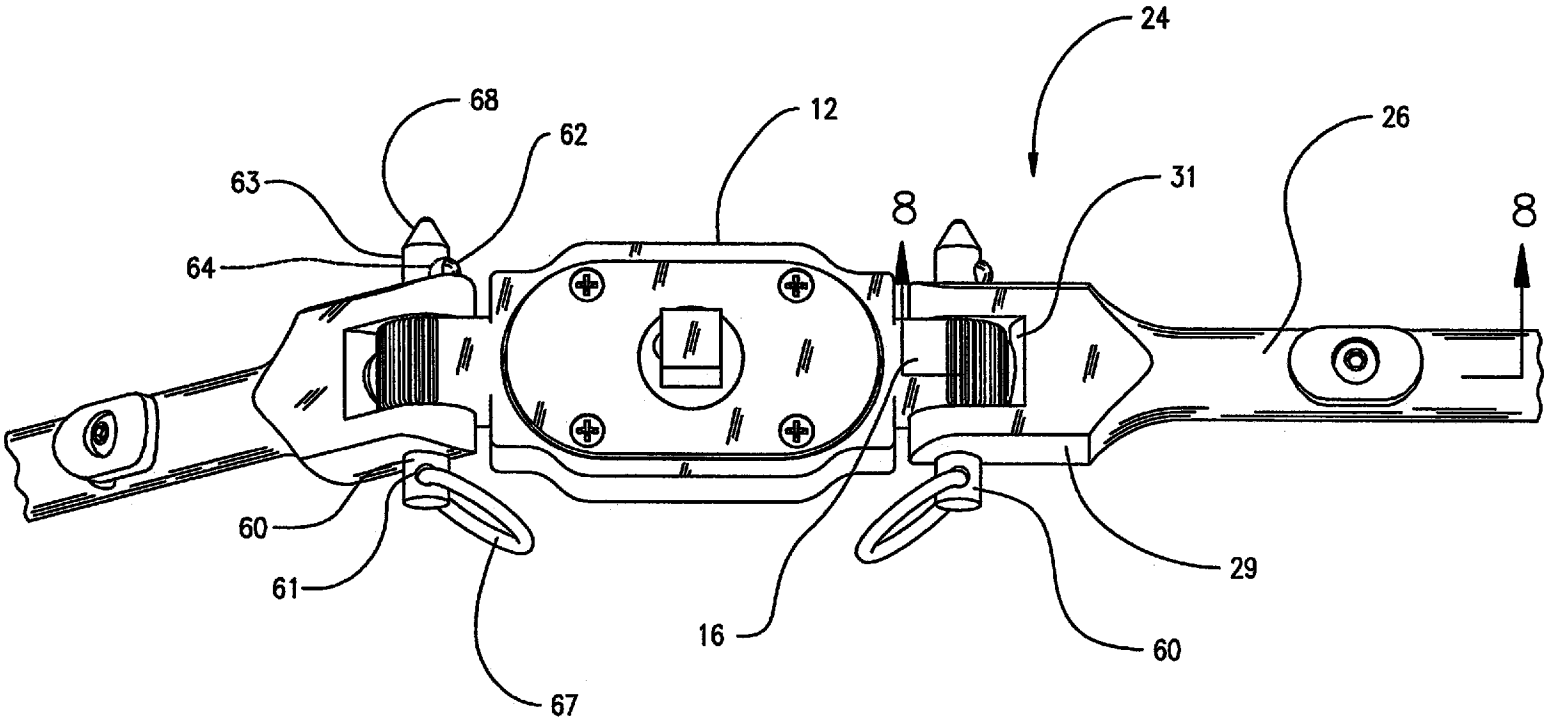
FIG. 6 shows a plan view of the ratchet wrench facing the drive end of the drive head.
Figure 7:
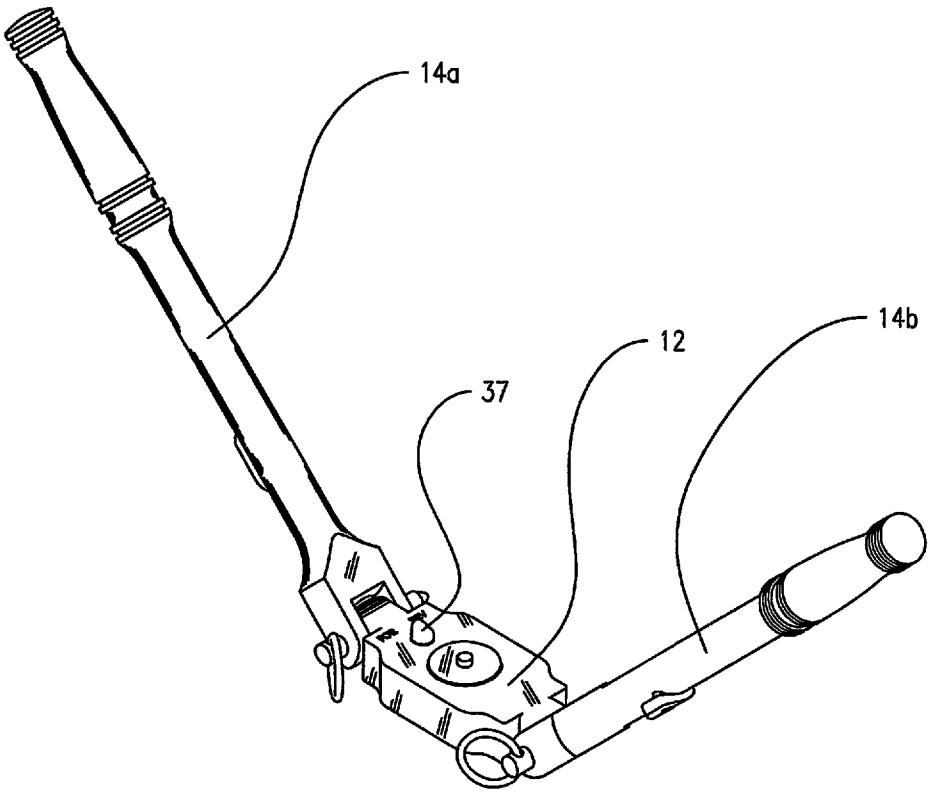
FIG. 7 shows a perspective view of the ratchet wrench from the back side, with its two handles in independently securable pivot position.
Figure 8:
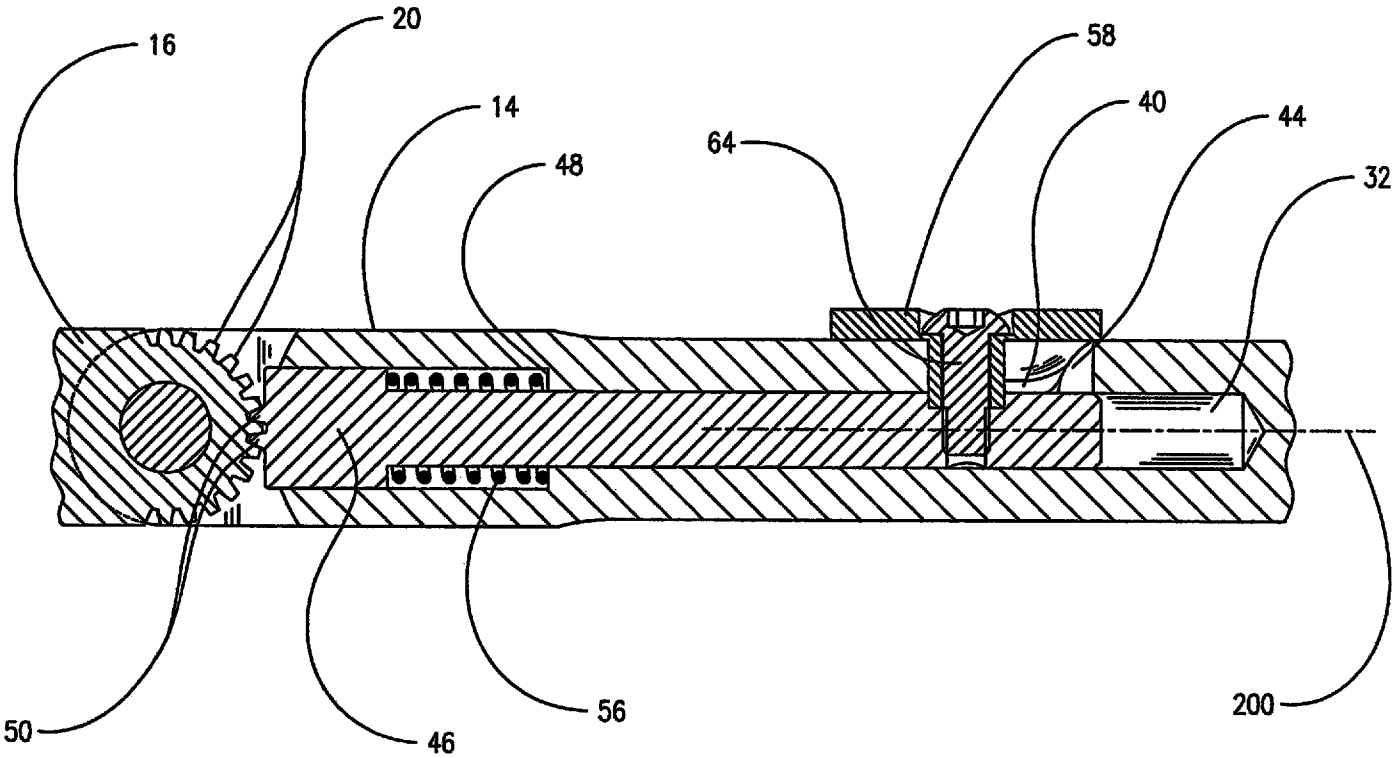
FIG. 8 shows a sectional view of the ratchet wrench of the invention taken through line 8-8 of FIG. 6, with the handle in an engaged state with the drive head.
Figure 9:
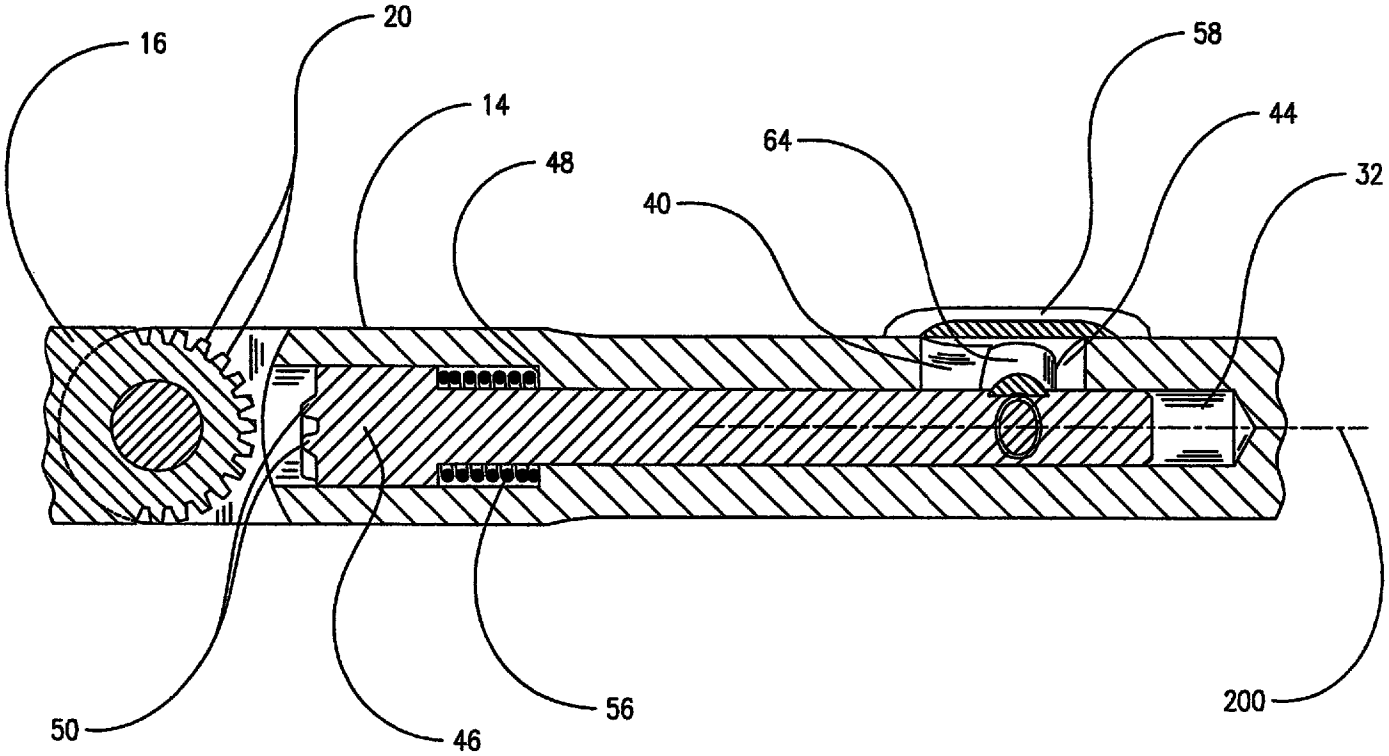
FIG. 9 shows the sectional view of the ratchet wrench of FIG. 8, with the handle in a non-engaged state with the drive head.
Figure 11:
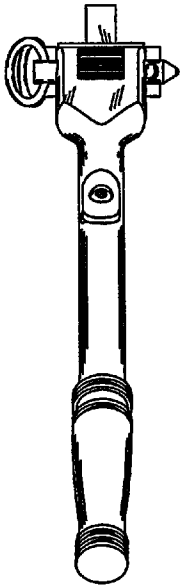
FIG. 11 shows a back elevation view of the dual handled ratchet wrench of the invention.
Figure 10:
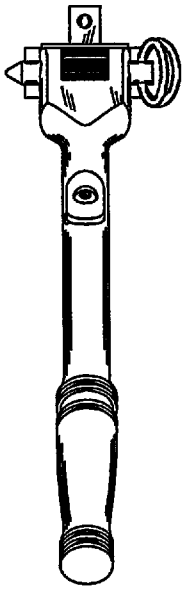
FIG. 10 shows a front elevation view of the dual handled ratchet wrench of the invention.
Figure 14:
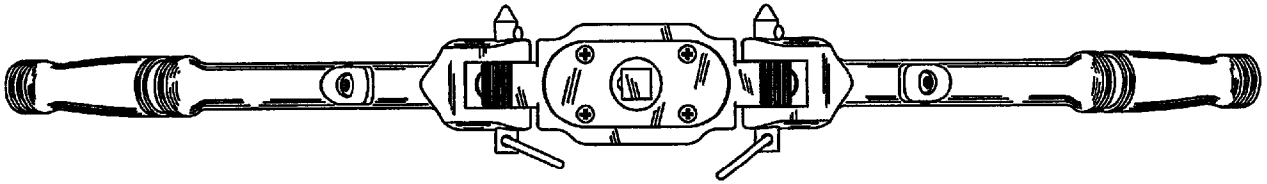
FIG. 14 shows a top plan view of the dual handled ratchet wrench of the invention.
Figure 12:
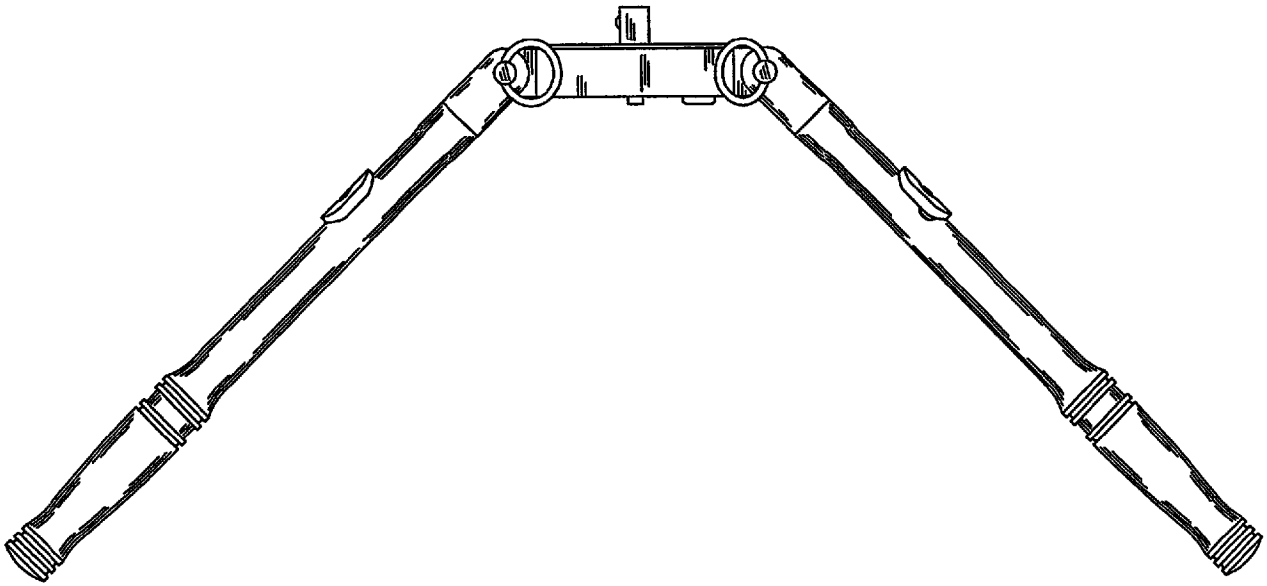
FIG. 12 shows a right elevation view of the dual handled ratchet wrench of the invention.
Figure 13:
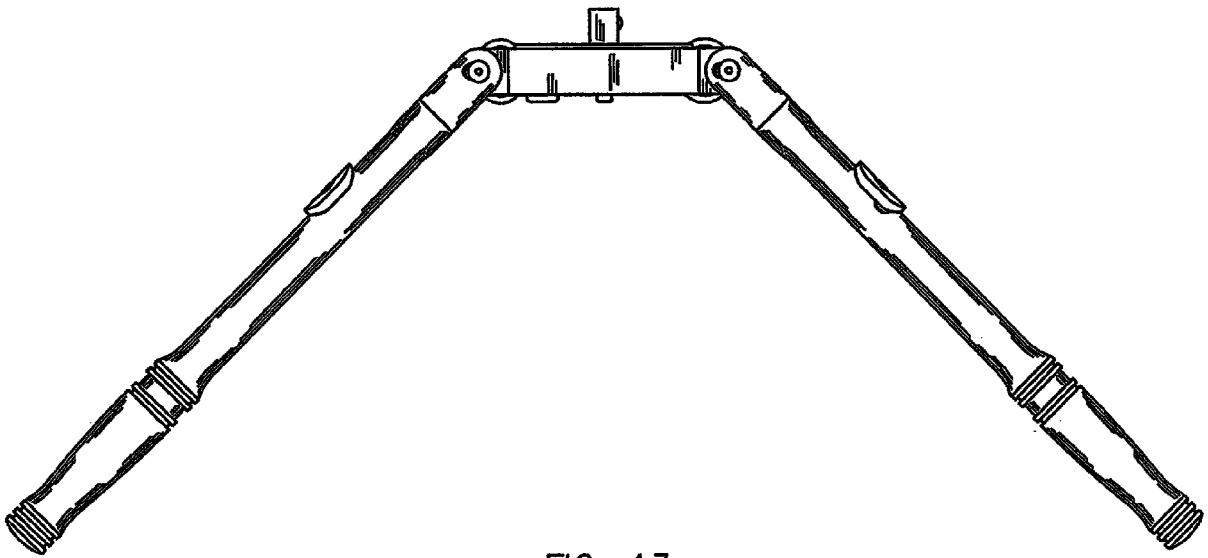
FIG. 13 shows a left elevation view of the dual handled ratchet wrench of the invention.
Figure 15:
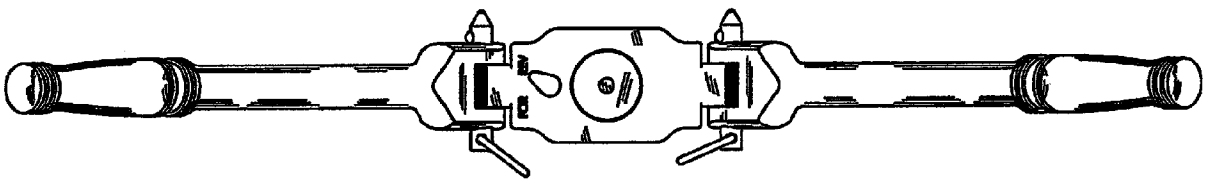
FIG. 15 shows a bottom plan view of the dual handled ratchet wrench of the invention.

In an embodiment of the invention, shown in FIG. 5, the handle 14 includes a securement or locking means for selectively securing the handle 14 at an angular pivot position during use. The securement includes a position securing rod 46 that moves axially within a bore 32 of the handle 14 between an engaged position and a non-engaged position. In the engaged position or condition as shown in FIG. 8, a pair of rod teeth 50 register within the slots between adjacent teeth 20 of the shank 16, thereby preventing relative angular movement of the handle 14 relative to the shank 16. A biasing structure, such as coil spring 56 disposed against a shoulder 48 in the proximal end of the bore 32, biases the rod 46 toward the engaged position. The rod 46 can be moved to its non-engaged position shown in FIG. 9, by exerting axial force upon a button 58 that is connected to the rod 46 in an axial direction toward the distal end of the handle, away from the clevis 24, which pulls the rod teeth 50 out of engagement with the shank teeth 20.

Once the rod teeth 50 are disengaged from the head teeth 20, a user can pivot the handle 14 relative to the drive head 12 to a different selected position, and release force on the button 58, causing the compressed force spring 56 to bias the rod teeth 50 back into engagement with the head teeth 20.

If a user wishes to maintain the rod 46 in its non-engaged condition and allow the ratchet head 12 to hinge freely about pin 60 relative to a handle 14, the user can slide the button 58 in the engagement slot 40, to the second slot end 44 and then rotates the button 58 (and the position securing rod 46 coupled thereto) clockwise about the axis 200 of the handle 14, causing button stem 64 to move into a side retaining slot (not shown), which prevents the force spring 56 from biasing the position securing rod 46 back to its engaged condition. This feature is described in detail in U.S. Pat. No. 6,405,621 issued to Krivec, the disclosure of which has been incorporated by reference in its entirety.

An alternative means for positioning the handle in a predetermined pivot position can be found in U.S. Pat. Nos. 6,898,998, 5,280,740, and 6,286,396, the disclosures of which are incorporated by reference in their entirety, which describe a non-locking and moveable means for the pivotable handle.

Each handle 14 also includes a quick-release pin 60 disposed in the bore 30 of each handle 14 and the bore 22 of the shank 16 to form a hinge, to allow the handle 14 to pivot about the pin 60 and with respect to the drive head 12. A retracting structure is secured to the pin 60 to provide a graspable structure for manually pulling on the pin. A ring 67 is passed through a hole in the body of the proximal end 61. The ring 67 is sized and shaped to allow the user to quickly and easily grasp manually the quick-release pin 60, with a finger, and to withdraw pin 60 from the hinge. Conversely, the user can insert with force the tapered tip 68 of the distal end 63 in through the coaxially aligned bores 30 and 22 of the handles 14 and shank 16, respectively.

The quick-release pin 60 includes a spring-biased ball 62 disposed in a spring hole 64 in the distal end 63. After the distal end 63 of the pin 60 passes through the bores of the first leg 28, the shank 16, and second leg 28 of the clevis, the spring-biased ball 62 clears the outer face wall 29 of the second leg 28, thereby releasable securing the pin 60 in place to form the hinge. Conversely, when the handle 14 needs to be removed quickly or promptly, the user grasps and pulls axially on the ring 67, forces the ball 62 against the outer face wall 29 of the clevis 28, which wall 29 forces the ball 62 down into the spring hole 62 out of engagement with the clevis and the shank for easy and rapid withdrawal, which uncouples the handle 14 from the drive head 12.

The quick-release pin provides a multi-functional drive wrench that can be quickly and easily adapted for a variety of uses by a mechanic, without the use of hand tool. When one of the handles is removed, the wrench can function as a single-handled drive wrench. When both handles are removed, the drive head can function as a handle-less or palm wrench. The handles can be easily and quickly reassembled onto the drive head, again without requiring hand tools.

The quick-release pin 60 shown is one example of a manually-withdrawable, quick-release pin, and other embodiments of the invention include quick-release pins as SLIC pins, positive lock pins, detent ring pins, clevis pins, detent clevis pins, ring pins, wire lock pins, bow-tie locking cotter pins, double loop hair pins, cotter pins, hair pin cotter, and circle cotter pins, any of which are available from Pivot Point, Inc. of Hustisford, Wis.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A dual-handled drive wrench, comprising:

a) a drive head including a drive post extending along a drive axis, and opposed first and second shanks extending radially from the drive axis, the first and second shanks each having a hole through the shank along a handle pivot axis;

b) a first handle and a second handle, each including a clevis at a proximal end having aligned holes through the legs of the clevis, the holes of the legs of the clevis aligned with the hole of the shank to provide a hinge that pivots around the handle pivot axis; and c) a manually-withdrawable, quick-release pin extending through the aligned holes of the clevis legs and shank, which can be withdrawn manually from the aligned holes without the use of a hand tool.

2. The dual-handled drive wrench of claim 1, wherein the drive head includes a ratcheting mechanism for the drive post, and a drive-direction selection switch.

3. The dual-handled drive wrench of claim 1, wherein the quick-release pin includes a spring-loaded ball detent mechanism at a distal end, and a grasping means at the proximal end for withdrawing the quick-release pin from the aligned holes of the clevis legs and shank by an axially applied pulling force.

4. The dual-handled drive wrench of claim 1, wherein the grasping means is a ring through the proximal end, which has an opening through which a finger can be inserted.

5. The dual-handled drive wrench of claim 4, wherein the drive head includes a ratcheting mechanism for the drive post, and a drive-direction selection switch.

6. The dual-handled drive wrench of claim 1, further including a locking mechanism for independently securing at least one of the first handle and the second handle at a variable pivot position relative to the respective shank of the drive head.

7. The dual-handled drive wrench of claim 6, wherein the drive head includes a ratcheting mechanism for the drive post, and a drive-direction selection switch.

8. The dual-handled drive wrench of claim 6, wherein the shank includes a part-cylindrical surface with head teeth thereon, and a rod having rod teeth and disposed within and moveable axially within a bore of the handle between an engaged position wherein the rod teeth engage the head teeth for locking the handle in a selected pivot position relative to the drive head, and a non-engaged position wherein the rod teeth are disengaged from the head teeth to allow relative pivoting movement of the handle around the handle pivot axis.

9. The dual-handled drive wrench of claim 8, wherein the drive head includes a ratcheting mechanism for the drive post, and a drive-direction selection switch.

* * * * *